US007668327B2

(12) United States Patent
Sluppke

(10) Patent No.: US 7,668,327 B2
(45) Date of Patent: Feb. 23, 2010

(54) HEARING AID WITH A VOLUME WHEEL

(75) Inventor: Klaus-Dieter Sluppke, Hamburg (DE)

(73) Assignee: Hansaton Akustik GmbH, Hamburg (DE)

( * ) Notice: Subject to any disclaimer, the term of this patent is extended or adjusted under 35 U.S.C. 154(b) by 768 days.

(21) Appl. No.: 11/268,899

(22) Filed: Nov. 8, 2005

(65) Prior Publication Data

US 2006/0104464 A1 May 18, 2006

(30) Foreign Application Priority Data

Nov. 13, 2004 (DE) ..... 10 2004 054 927

(51) Int. Cl.
*H04R 25/00* (2006.01)

(52) U.S. Cl. ..... 381/324; 381/312; 381/322

(58) Field of Classification Search ..... 381/324
See application file for complete search history.

(56) References Cited

U.S. PATENT DOCUMENTS

| | | | | |
|---|---|---|---|---|
| 4,803,458 | A | 2/1989 | Trine et al. | |
| 4,922,540 | A | 5/1990 | Erbe | |
| 6,700,983 | B1 * | 3/2004 | Bøgeskov-Jensen et al. | 381/322 |
| 6,809,275 | B1 * | 10/2004 | Cheng et al. | 200/14 |
| 7,079,110 | B2 | 7/2006 | Ledbetter et al. | |
| 2003/0025673 | A1 | 2/2003 | Ledbetter et al. | |

FOREIGN PATENT DOCUMENTS

| | | | |
|---|---|---|---|
| DE | 3503390 | A1 | 8/1985 |
| DE | 8708894 | U1 | 12/1988 |
| DE | 3850322 | T2 | 3/1989 |
| EP | 0724278 | A2 | 7/1996 |
| EP | 0901262 | A2 | 3/1999 |
| EP | 1150243 | A2 | 10/2001 |
| EP | 1455370 | A1 | 3/2004 |

OTHER PUBLICATIONS

WO 99/43193, Behind-the-Ear Hearing Aid, Publication Date: Sep. 2, 1999.

* cited by examiner

*Primary Examiner*—Brian Ensey
*Assistant Examiner*—Matthew Eason
(74) *Attorney, Agent, or Firm*—Rankin, Hill & Clark LLP

(57) ABSTRACT

A hearing aid (1), fitted with an aperture (4) in a wall of a case (2, 3) receiving an adjustment wheel (5) which can be rotated from the outside by finger action around an axis of rotation (6) configured parallel to the wall (2), the adjustment wheel (5) driving a continuously adjustable electric volume control (7, 8), is characterized in that the adjustment wheel (5) rests in such manner at a shifting element (10) mounted in the case (2, 3) that a switch (13) shall be actuated when said wheel (5) is driven against a spring force (14) in the direction of shifting (17, 18, 19, 20).

5 Claims, 1 Drawing Sheet

HEARING AID WITH A VOLUME WHEEL

BACKGROUND OF THE INVENTION

Besides microphones and loudspeakers, hearing aids also contain an amplifier circuit fitted with a volume control to adjust to individual needs. Push button switches electronically adjusting the volume in discrete steps already are known, however their ease of regulation is highly unsatisfactory.

Hearing aids of the above kind allow continual adjustment of the volume by rotating an adjustment wheel. This feature is more advantageous ergonomically and allows rapid coarse as well as fine adjustments. The design is widely used in hearing aids of all kinds.

However, in addition to volume control, hearing aids also require the setting of different operational modes, for instance when switching listening from the acoustic mode to an electromagnetic telephone receiver mode. For that purpose conventional hearing aids comprise additional switches reaching through the casing, as illustratively disclosed in U.S. Pat. No. 6,700,983 B1. Additional button switches however entail additional space requirements, raising problems for the very restricted space available in very small hearing aids. Moreover, additional switches do impair the aesthetics highly prized by aid wearers. Another problem in this respect is that operation by finger entails a minimum spacing between the volume control and the button switch in order to preclude simultaneously depressing the button switch when intending to adjust the volume control for instance. Typical finger size requires a spacing of about 10 mm (½ inch); as a result of the hearing aid's required minute size, considerable packing problems are then encountered.

The German patent document 3,503,390 A1 discloses a hearing aid where a push button switch to discretely adjust the volume is combined with a rotary switch to turn the aid ON/OFF. A similar compound switch is shown in the patent document WO 99/43193 combining a volume-changing push button switch with an ON/OFF slide switch.

The objective of the present invention is to create a hearing aid of the above species which shall be fitted with a compact and aesthetically acceptable switch.

BRIEF SUMMARY OF THE INVENTION

In the present invention, in addition to its rotary volume control, the adjustment wheel also acts as a slide switch, whereby the rotation of the adjustment wheel adjusts the volume and the sliding motion drives a switch. The sliding action is implemented by a shifting element mounted inside the case. The switch requires no outside switch elements. By tight spatial integration exceedingly compact and economical design is possible.

The adjustment wheel's sliding motion may take place in the direction of its axis of rotation, illustratively being implemented by applying a finger nail to the side of the adjustment wheel. Preferably, the adjustment wheel's shifting motion is applied in a simple manner by the pressure of a finger, such a pressure perpendicular to the axis of rotation at the same time also precluding unintentional wheel rotation.

Illustratively the depressing element might be fitted with a parallel guide element. Preferably, the depressing element is designed to pivot the adjustment wheel around a pivot pin. This feature allows great simplicity and offers a number of design advantages.

For instance, the pivot pin may run orthogonally to the said axis of rotation, as a result of which the adjustment wheel will be shifted in the direction of the axis of rotation. Advantageously, however, the pivot pin runs parallel to the axis of rotation. The adjustment wheel then is shifted perpendicularly to the axis of rotation and the aforementioned advantages are attained.

The switch to be driven by shifting can be directly driven by the adjustment wheel. Preferably, by the lever driving the switch, an appropriate selection of the switch site relative to the lever length offers ways to select desired ratios of force to excursion at the switch. Furthermore, this feature eliminates difficult-to-design switch actuation directly by the adjustment wheel.

In a known manner, said adjustment wheel is mounted on or in its own case which illustratively irrotationally bears an adjustment-wheel driven rotary potentiometer. This casing is provided by the shifting element and therefore is integrated with it, for instance with the pivot lever in one unit in a compact and economical manner.

The present invention is shown in illustrative and schematic manner in the appended drawings.

DETAILED DESCRIPTION OF THE INVENTION

Figure 1:
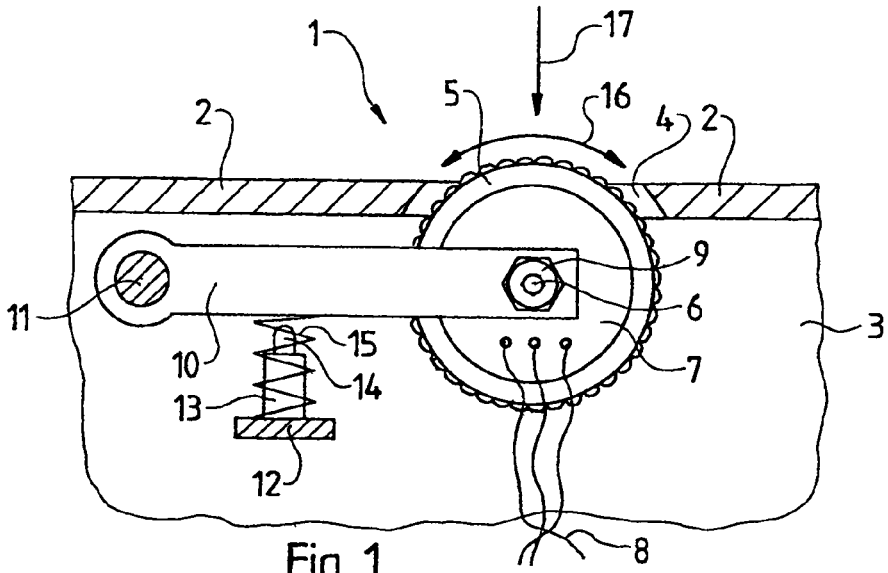
FIG. 1 shows a partial section of a hearing aid case of a first embodiment of the present invention.

FIG. 1 shows a hearing aid 1 fitted with a case of which the partial representation of FIG. 1 shows a top wall 2 and a rear wall 3. The top wall 2 comprises a basically rectangular aperture 4.

An adjustment wheel 5 is mounted in a partly protruding manner in the aperture 4 and is supported to rotate about an axis of rotation 6 which, as indicated in FIG. 1, is parallel to the top wall 2.

A housing plate 7 is configured in an irrotational manner relative to the irrotational axis of rotation 6 and bears a conventional rotary potentiometer which for the sake of clarity is omitted from FIG. 1. Said potentiometer is fitted, for instance, in a conventional manner with a concentric electric resistance path tapped by a wiper turning jointly with the wheel 5. This potentiometer is connected by conductors 8 to the omitted electronics of the hearing aid 1 in a manner that the volume shall be adjustable by rotating the adjustment wheel 5.

The entire potentiometer together with the adjustment wheel 5 is mounted in an irrotational manner by means of a nut 9 and the irrotational axis of rotation 6 to the free end of a lever 10 which at its other end rests pivotably on a pivot pin 11. In this embodiment, the pivot pin 11 is affixed for instance integrally to the rear wall 3.

A bracket 12 affixed to the rear wall 3 supports a switch 13 of which the actuation element 14 is configured within the pivoting range of the lever 10 that in turn rests by a helical spring 15 against said bracket 12. The switch 13 is electrically connected by omitted conductors to the electronics of the hearing aid 1, for instance, to switch to specific operational modes or to different modes of operation using actuations of different lengths of time, for instance complex motions in a command menu. If the restoring spring force of the actuation element 14 is sufficiently large, the spring 15 may be eliminated as being superfluous.

The volume of the hearing aid 1 is adjusted by rotating the adjustment wheel 5 in the direction of the arrow 16. By pressing the adjustment wheel 5 in the direction of the arrow 17, the lever 10 is pivoted downward about the pivot pin 11 and thus will drive the actuation element 14 of the switch 13 to issue commands to the electronics.

Figure 2:
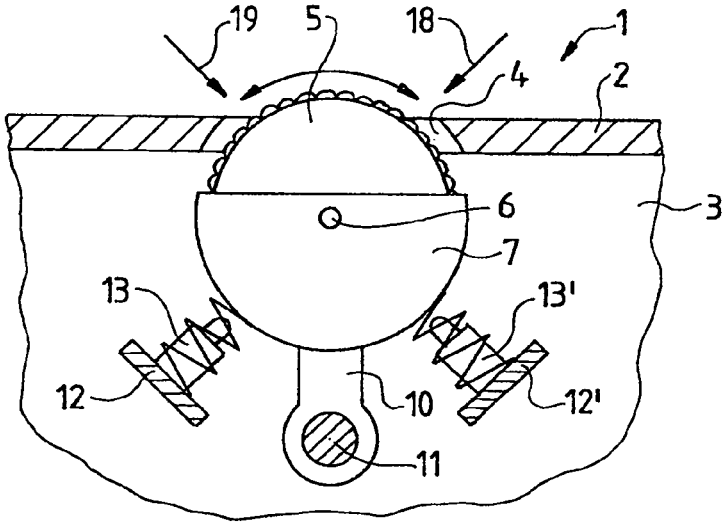
FIG. 2 is a section along FIG. 1 of a second embodiment of the present invention.
Figure 3:
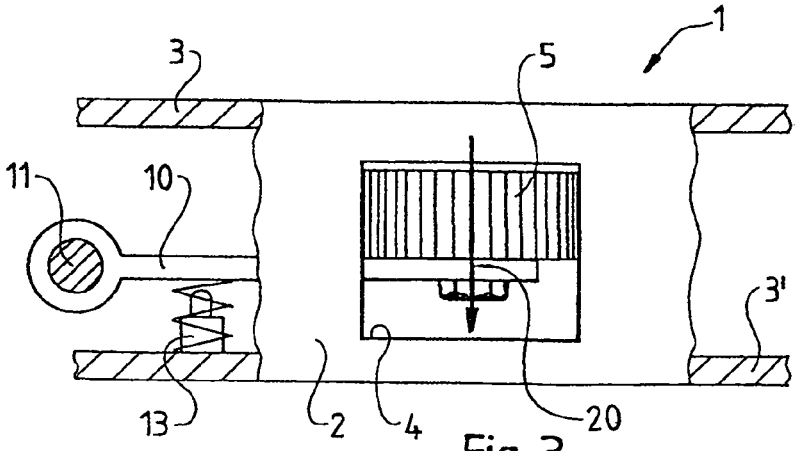
FIG. 3 is a view from above relating to FIG. 1 of a third embodiment of the present invention.

FIGS. 2 and 3 show further embodiment modes of the invention, their references being the same as much as possible as those of FIG. 1.

As regards the embodiment mode of FIG. 2, the adjustment wheel 5 is configured in the same manner as in FIG. 1 in the aperture 4 of the case's top wall 2. Said wheel however is fitted with a partly enclosing casing 7 instead of a laterally mounted case plate, said casing 7 being integral with the lever 10. Again, the pivot pin 11 is parallel to the axis of rotation 6 though it is configured below the adjustment wheel 5 in a manner that said wheel is able to tip forward and rearward about said pivot pin 11. When pressure is applied to the adjustment wheel 5 in the direction of the arrow 18, a tipping motion ensues to the left in FIG. 2, and as a result the case 7 will actuate a switch 13. When applying a pressure to the adjustment wheel 5 in the direction of the arrow 19, tipping takes place toward the right, whereby the casing 7 actuates a second switch 13'. This design allows actuating two switches 13, 13' independently from each other.

FIG. 3 shows an embodiment mode seen in top view relative to the assembly of FIG. 1. This design, while substantially corresponding to that of FIG. 1, nevertheless exhibits a substantive difference.

In this latter embodiment, the pivot pin 11 of the lever 10 is not parallel to the axis of rotation 6, but instead it is orthogonal to it, and illustratively this pin 11 is affixed to the top wall 2. The switch 13, which in other respects corresponds identically to that of FIG. 1, is now affixed directly to the case front wall 3'.

As regards the embodiment mode of FIG. 3, the volume may be adjusted by rotating the adjustment wheel 5 in the same manner as in FIG. 1. However a force is applied in the direction of the arrow 20 to the adjustment wheel to actuate the switch 13, that is in the direction of said wheel's axis of rotation. In the process, the lever 10 pivots about the pivot pin 11 and thereby actuates the switch 13.

The invention claimed is:

1. A hearing aid, fitted with an aperture in a wall of a case receiving an adjustment wheel being pivoted around an axis of rotation configured parallel to the wall in a manner so that it can be reached from the outside by a finger, the adjustment wheel driving a continuously adjustable electric volume control, wherein the adjustment wheel rests in such manner at a lever, pivotably resting on a pivot pin, mounted in the case that a switch for changing hearing aid operation modes shall be actuated when said wheel is driven against a spring force in the direction of shifting.

2. Hearing aid as claimed in claim 1, wherein the lever is displaceable orthogonally to the axis of rotation.

3. Hearing aid as claimed in claim 1, wherein the pivot pin is parallel to the axis of rotation.

4. Hearing aid as claimed in claim 1, wherein the lever is configured to drive the switch.

5. Hearing aid as claimed in claim 1, wherein the lever comprises a casing of the adjustment wheel.

* * * * *